US005455977A

United States Patent [19]

Caffrey et al.

[11] Patent Number: 5,455,977

[45] Date of Patent: Oct. 10, 1995

[54] BOWLING LANE DRESSING APPARATUS WITH CONTINUOUSLY VARIABLE SPEED DRIVE

[75] Inventors: Stephen F. Caffrey, Arvada; Bruce Hitchcock, Littleton, both of Colo.

[73] Assignee: AMF Bowling, Inc., Golden, Colo.

[21] Appl. No.: 280,276

[22] Filed: Jul. 25, 1994

[51] Int. Cl.[6] ..... A47L 11/03; A63D 5/10

[52] U.S. Cl. ..... 15/98; 118/207; 118/260

[58] Field of Search ..... 15/98, 103.5; 118/262, 118/207, 260

[56] References Cited

U.S. PATENT DOCUMENTS

| | | | |
|---|---|---|---|
| 3,216,037 | 11/1965 | Stevens et al. | 15/98 |
| 4,959,884 | 10/1990 | Ingermann et al. | 15/302 |
| 5,161,277 | 11/1992 | Ingermann et al. | 15/98 |
| 5,181,290 | 1/1993 | Davis et al. | 15/98 |
| 5,243,728 | 9/1993 | Smith et al. | 15/98 |
| 5,274,871 | 1/1994 | Smith et al. | 15/98 |

*Primary Examiner*—Edward L. Roberts, Jr.
*Attorney, Agent, or Firm*—Gary D. Fields

[57] ABSTRACT

A bowling lane dressing apparatus is provided which has a carriage for movement along the bowling lane between the foul line and the pit. Drive wheels are rotatably mounted on the carriage for moving the carriage along the bowling lane by means of drive means connected thereto. A lane buffer roller is journaled on the carriage in lane-contacting relation which extends transversely to the direction of travel. A reservoir is mounted in the carriage for storage of lane-dressing fluid. A transfer roller is mounted in rolling engagement with the lane buffer roller and in fluid communication with the reservoir for transferring fluid from the reservoir to the lane buffing roller. Variable speed drive motor is connected to the drive wheels for rotating them at variable speeds to vary the speed of the carriage as it moves along the bowling lane to vary the rate of transfer of fluid to the bowling lane surface by the lane buffer roller.

4 Claims, 3 Drawing Sheets

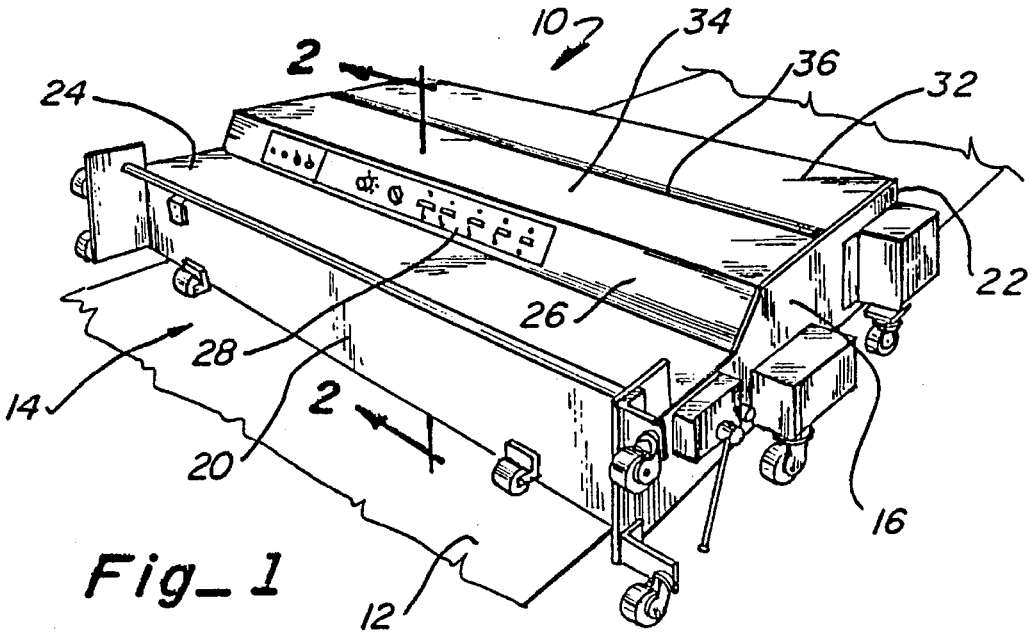
Fig_1
Fig_2
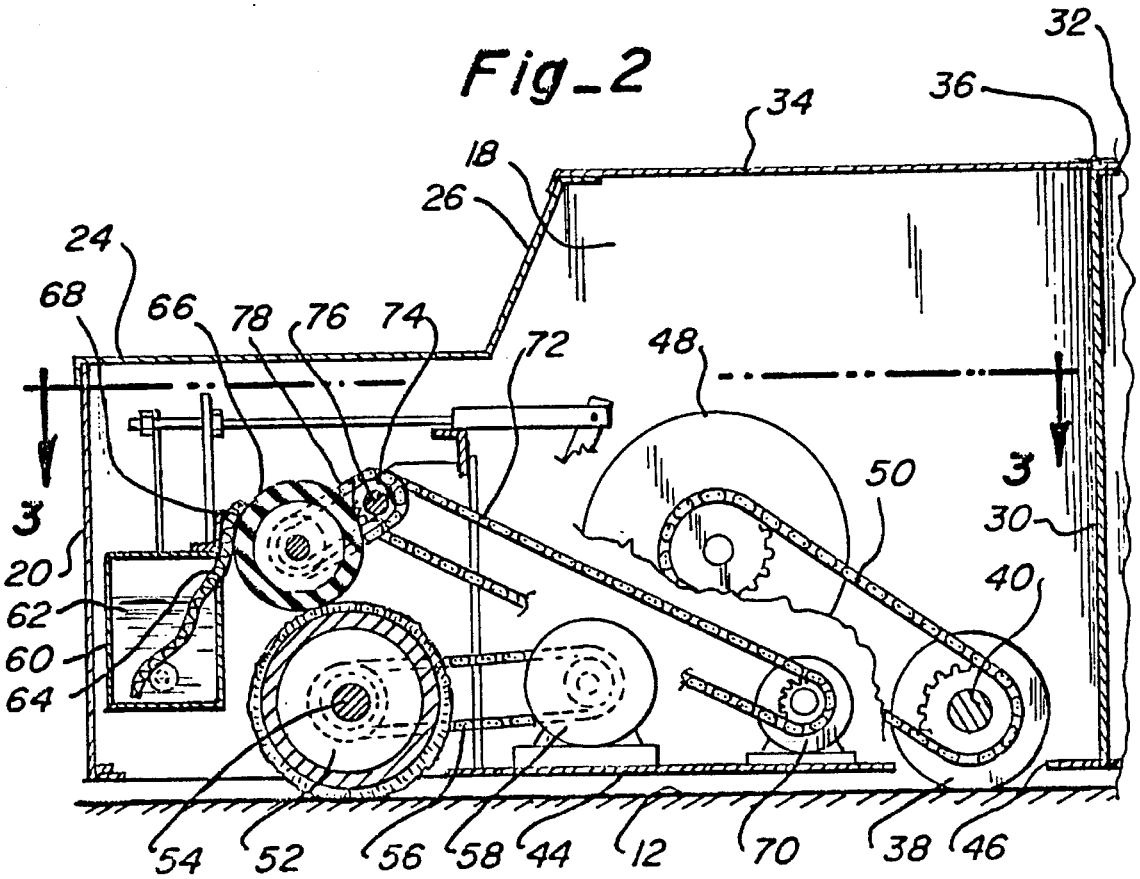

BOWLING LANE DRESSING APPARATUS WITH CONTINUOUSLY VARIABLE SPEED DRIVE

TECHNICAL FIELD

This invention relates to a drive mechanism for a bowling lane dressing apparatus and more particularly to one in which the speed of the drive mechanism can be varied continuously or selectively over a wide range of speeds to more precisely control the amount of oil placed on a bowling lane.

BACKGROUND ART

Stevens et al. U.S. Pat. No. 3,216,037 for "Lane Maintenance Machine" discloses a variable speed metering roller and describes that the speed at which the machine is driven along the bowling lane may be selectively varied by using variable speed pulleys. However, there is no suggestion that this structure can be used to vary the amount of bowling lane dressing applied to the bowling lane.

Ingermann et al. U.S. Pat. No. 4,959,884 for "Combination Bowling Lane Stripper and Dressing Apparatus", among other limitations, discloses a transfer device for transferring dressing oil from a reservoir to an applicator roller. This device includes a transfer roller which receives oil from the reservoir by means of a wick and then transfers the oil to an applicator roller. The transfer roller is driven by a chain drive between it and the drive rollers for moving the device down the bowling lane. The device includes pressure fingers which can be adjusted to vary the amount of oil transferred from the reservoir to the transfer roller so that different amounts of oil can be applied to different boards across the width of the bowling lane. However, for any given pressure across the transfer roller, the amount of oil applied from the transfer roller to the buffer roller is strictly a function of the speed of the guide roller and can be varied only by varying the viscosity of the oil in the reservoir. Thus, the degree of control available with that device is limited.

Ingermann et al. U.S. Pat. No. 5,161,277 for "Variable Speed Transfer Roller For Bowling Lane Dressing Apparatus" discloses the use of a variable speed motor for driving the transfer roller so that the greater the speed of the roller the greater the rate of fluid transfer from the reservoir to the lane buffer roller and visa versa.

Smith et al. U.S. Pat. No. 5,243,728 for "Multiple Independent Variable Speed Transfer Rollers For Bowling Lane Dressing Apparatus" discloses the use of a segmented transfer roller wherein the segments can be driven at varying speeds to provide control of lateral distribution of bowling lane dressing across the alley by driving the respective segments at different speeds.

Smith et al. U.S. Pat. No. 5,274,871 for "Multiple Tanks For Applying Lane Dressing to Transfer Roller For Bowling Lane Dressing Apparatus" disclosed the use of multiple pivoted tanks for bringing the respective wicks extending from the tanks into contact with corresponding transfer rollers to provide further control of the pattern of the application of lane dressing to a bowling lane surface.

DISCLOSURE OF THE INVENTION

In accordance with this invention, a bowling lane dressing apparatus is provided which has a carriage for movement along the bowling lane between the foul line and the pit. Drive wheels are rotatably mounted on the carriage for moving the carriage along the bowling lane by means of a first variable speed drive means connected thereto. A lane buffer roller is journaled on the carriage in lane-contacting relation which extends transversely to the direction of travel. The lane buffing roller is driven by a second drive means. A reservoir is mounted in the carriage for storage of lane-dressing fluid. A transfer roller is mounted in rolling engagement with the lane buffer roller and in fluid communication with the reservoir for transferring fluid from the reservoir to the lane buffer roller. This variable speed drive means causes the carriage to move along the bowling lane at variable speeds continuously over a wide range of speeds to vary the rate of transfer of fluid from the lane buffer roller to the bowling lane.

More specifically, the variable speed drive means includes a variable speed motor mounted on the carriage and connected to the drive wheels to control the speed at which the carriage moves down the bowling lane. With the lane buffer roller being driven at a constant speed, the faster the carriage moves down the bowling lane the less dressing that will be applied and the slower the carriage moves down the bowling lane the more lane dressing that will be applied. A variable resistor is connected in series with the variable speed motor for varying the speed thereof over a wide range. Advantageously, this speed will range anywhere between 40 rpm and 100 rpm, but other speeds are within the scope of this invention.

From the foregoing, it will be apparent that the application of lane-dressing fluid to a buffer roller will not be limited by the viscosity of the fluid, but rather can be controlled within broad limits by increasing or decreasing the speed of the carriage so that when the speed increases less fluid is applied by the buffer roller and when it is driven at a slower speed more fluid is applied by the buffer roller. This allows the carriage to move at varying speeds during each pass of the carriage down the alley to continuously or selectively vary the amount of lane dressing applied at any particular longitudinal location along the lane.

Additional advantages of this invention will become apparent from the description which follows, taken in conjunction with the accompanying drawings.

BRIEF DESCRIPTION OF THE DRAWINGS

FIG. 1 is a perspective view of a bowling lane dressing apparatus constructed in accordance with this invention;

FIG. 2 is an enlarged vertical section, taken along 2—2 of FIG. 1, showing the variable speed motor for driving the carriage down the bowling lane;

BEST MODE FOR CARRYING OUT THE INVENTION

Figures 3, 4:
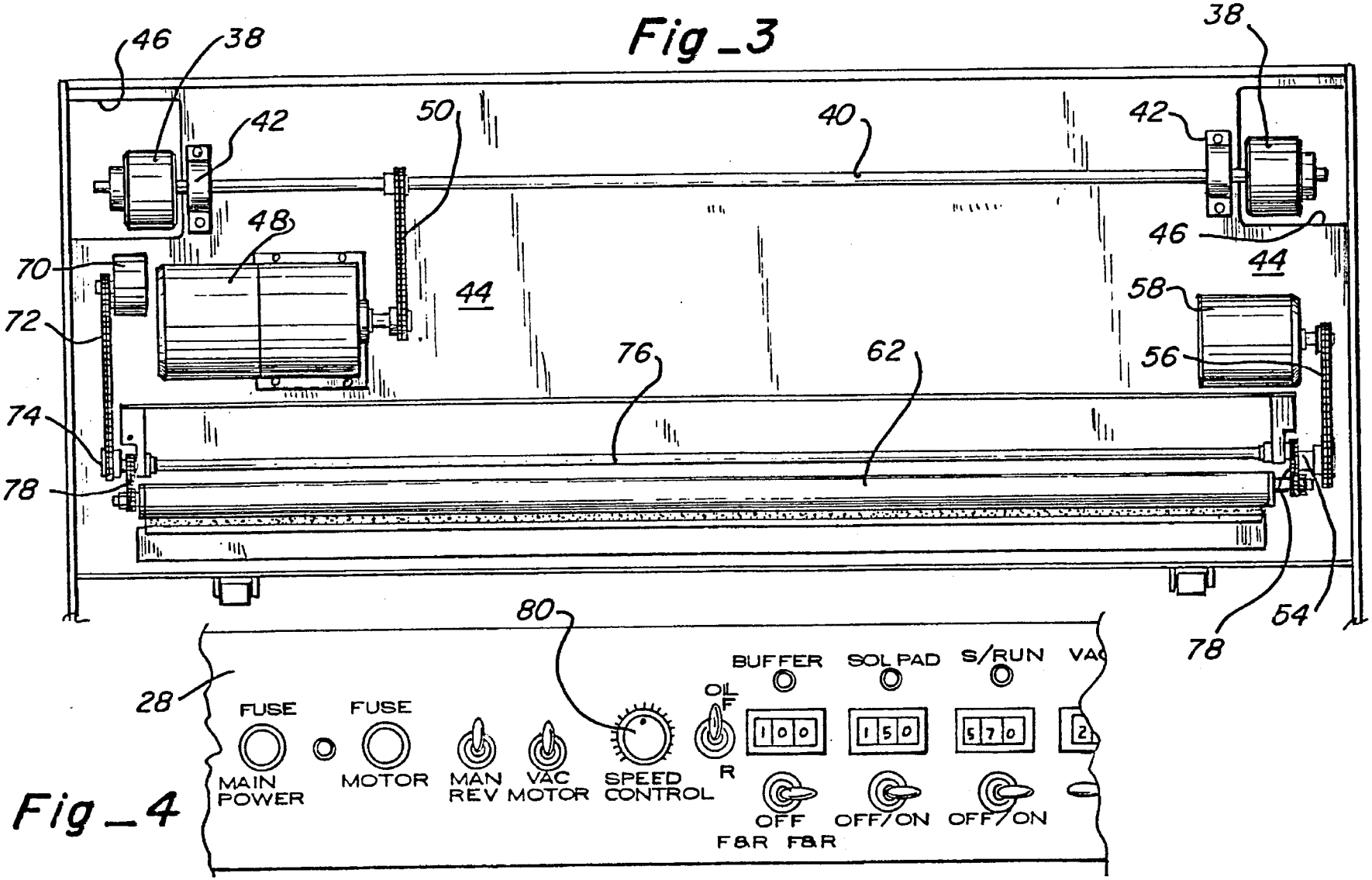
FIG. 3 is a horizontal section, taken along line 3—3 of FIG. 2, showing further details of the apparatus.
FIG. 4 is an enlarged fragmentary view of the control panel for the bowling lane dressing apparatus.

In accordance with the present invention, a dressing apparatus 10 is provided which can be mounted for travel along a bowling lane 12, as shown in FIG. 1. The apparatus has a carriage 14 which houses all of the functional elements of the apparatus. The carriage includes opposite side walls 16 and 18 interconnected by a front wall 20 and a rear wall 22. A top cover 24 extends from the upper edge of front wall 20 and terminates in an upstanding angular wall 26 in which a control panel 28 is mounted for controlling the various functions of the apparatus. A transverse wall 30, shown in FIG. 2, divides a forward portion of the carriage from a rear portion. The device is provided with a top cover having a pivotal section 34 connected to cover 32, as by a piano hinge 36 to provide access to the interior of carriage 14. Details of the mechanics of this device, other than those described below, can be found in Ingermann et al. U.S. Pat. No. 4,959,884 for "Combination Bowling Lane Stripper and Dressing Apparatus" which is incorporated herein by reference.

As best seen in FIGS. 2 and 3, the carriage 14 is provided with spaced drive wheels 38 interconnected by a rotatable shaft 40 journaled adjacent opposite ends and bearings 42. The drive wheels 38 engage the surface of bowling alley 12 for moving the carriage longitudinally along the alley for applying the lane dressing. Conveniently, carriage 14 has a bottom wall 44 having openings 46 therein through which drive wheels 38 extend for contacting the surface of bowling lane 12. A drive shaft 40 interconnects drive rollers 38 and is driven by variable speed drive motor 48 through chain drive 50.

The buffer roller 52 is mounted for rotation with central shaft 54 and is positioned to contact bowling alley 12 to apply the bowling lane dressing thereto. Shaft 54 is driven by a drive chain 56 from motor 58 at a constant speed.

A tank 60 is mounted adjacent buffer roller 52 within carriage 14 and contains a supply of dressing liquid 62. Conveniently, a wick 64 extends from the liquid to a position in engagement with transfer roller 66 which is in peripheral contact with buffer roller 52. Thus, the dressing liquid 62 will be transferred by wick 64 to transfer roller 66 and by transfer roller 66 to buffer roller 52. One or more pressure fingers 68 can be provided at the top of tank 60 for pressing the upper end of wick 64 against transfer roller 66 to control the rate at which liquid is transferred from wick 64 to transfer roller 66.

A constant speed motor 70 is connected by means of a drive chain 72 to a sprocket 74. This sprocket is connected to the end of a shaft 76 which is interconnected to transfer roller 66 by drive a chain 78 at each end of the transfer roller. Although a transfer means in the form of transfer roller 66 and the associated parts just described for turning it has been shown and illustrated, it should be understood to one skilled in the art that any type of transfer means for transferring liquid from the reservoir 60 to buffer roller 52. By way of example only, such a transfer means could include sprayers or it include the use of wicks or pads which directly contact the buffer roller and are supplied with lane dressing fluid from reservoir 60. Additionally, although motor 70 has been described as a constant speed motor, it will be understood that the transfer roller could also be driven at a variable speed by a variable speed motor in the manner shown in Ingermann U.S. Pat. No. 5,161,277 or a plurality of individually driven transfer rollers could be used as disclosed in Smith et al. U.S. Pat. No. 5,243,728.

Figure 5:
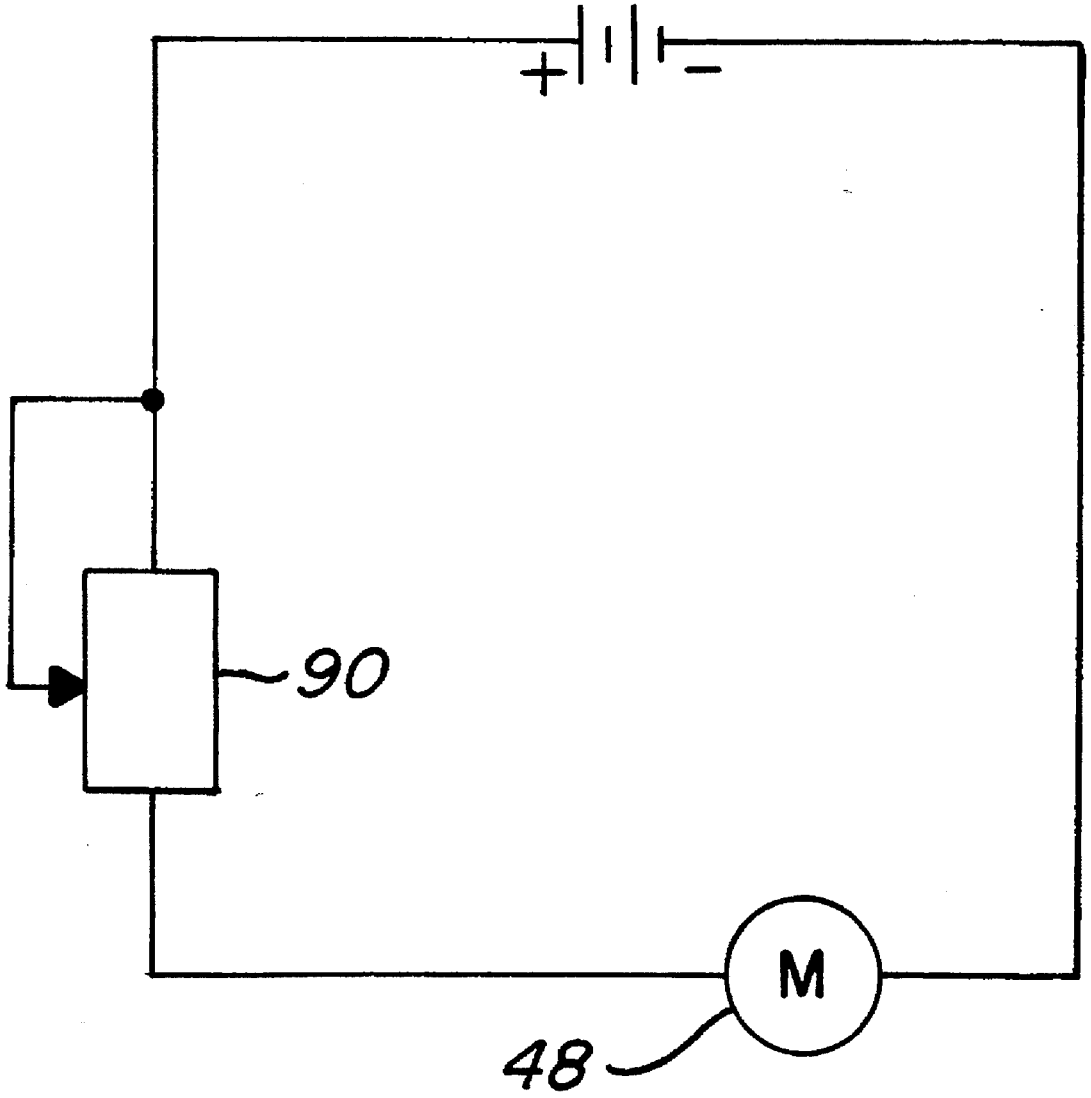
FIG. 5 is a schematic diagram of a motor control circuit illustrating a rheostat controlling the variable speed drive motor.

Conveniently, as shown in FIGS. 4 and 5, the control panel 28 has a variable speed control 80 which includes a variable resistor in the form of a rheostat 90 and is connected to variable speed motor 48 in a manner well understood by those skilled in the art. Thus, the speed of motor 48 can be varied continuously or selectively over a wide range of speed as desired to vary the speed of drive wheels 38 and carriage 14 as it travels down the bowling lane. By speeding up the speed of drive wheels 38, less lane dressing fluid is applied by buffer roller 52 and by slowing down drive wheels 38 more lane dressing fluid is applied by buffer roller 52. This arrangement provides a degree of control of the application of lane dressing fluid to the bowling lane which does not require varying the speed of the transfer roller as is true with certain prior art devices discussed above.

This invention has been described in detail with reference to particular embodiments thereof, but it will be understood that various other modifications can be effected within the spirit and scope of this invention.

We claim:

1. A bowling lane dressing apparatus for applying varying amounts of bowling lane dressing to the surface of a bowling lane, said apparatus comprising:

a carriage for movement along a bowling alley between a foul line and pit;

drive wheels rotatably mounted on said carriage in lane-contacting relation and extending transversely to the direction of travel;

a reservoir in said carriage for the storage of lane-dressing fluid;

a lane buffer roller journaled on said carriage for rotation with its surface in lane-contacting relation to transfer lane dressing fluid to the bowling alley;

transfer means in engagement with said lane buffer roller and in fluid communication with said reservoir for transferring fluid from said reservoir to said lane buffer roller; and variable speed drive means connected to said drive wheels for rotating them at variable speeds to vary the rate of movement of said carriage along the bowling lane to control the transfer of fluid to the bowling lane surface by said lane buffer roller, said variable speed drive means including:

a variable speed motor mounted on said carriage connected to said drive wheels to rotate said drive wheels at a speed relative to the speed of rotation of said variable speed motor; and a variable resistor connected to said variable speed motor for varying the speed of said variable speed motor.

2. Apparatus, as claimed in claim 1, wherein:

said transfer means includes a transfer roller and a drive motor connected thereto for rotating said transfer roller.

3. A bowling lane dressing apparatus for applying varying amounts of bowling lane dressing to the surface of a bowling lane, said apparatus comprising:

a carriage for movement along a bowling alley between a foul line and pit;

drive wheels rotatably mounted on said carriage in lane-contacting relation and extending transversely to the direction of travel;

a reservoir in said carriage for the storage of lane-dressing fluid;

a lane buffer roller journaled on said carriage for rotation with its surface in lane-contacting relation to transfer lane dressing fluid to the bowling alley;

a transfer roller mounted in rolling engagement with said lane buffer roller and in fluid communication with said reservoir for transferring fluid from said reservoir to said lane buffer roller;

a first drive means connected to said transfer roller for rotating the same;

a second drive means connected to said lane buffer roller for rotating said lane buffer roller; and variable speed drive means connected to said drive wheels for rotating them at variable speeds to vary the rate of movement of said carriage along the bowling lane to control the transfer of fluid to the bowling lane surface by said lane buffer roller, said variable speed drive means including:

a variable speed motor mounted on said carriage connected to said drive wheels to rotate said drive wheels at a speed relative to the speed of rotation of said variable speed motor; and a variable resistor connected to said variable speed motor for varying the speed of said variable speed motor.

4. Apparatus, as claimed in claim 3, wherein:

said first drive means is a variable speed motor.

* * * * *